US010711485B2

(12) United States Patent
Li

(10) Patent No.: US 10,711,485 B2
(45) **Date of Patent: *Jul. 14, 2020**

(54) DOOR LOCK

(71) Applicant: Zhongshan Huibao Lock Manufacturing Co., Ltd., Zhongshan (CN)

(72) Inventor: Weixuan Li, Zhongshan (CN)

(73) Assignee: ZHONGSHAN HUIBAO LOCK MANUFACTURING CO., LTD., Zhongshan (CN)

( * ) Notice: Subject to any disclaimer, the term of this patent is extended or adjusted under 35 U.S.C. 154(b) by 408 days.

This patent is subject to a terminal disclaimer.

(21) Appl. No.: 15/624,727

(22) Filed: Jun. 16, 2017

(65) Prior Publication Data

US 2018/0363324 A1 Dec. 20, 2018

(51) Int. Cl.

| | |
|---|---|
| ***E05B 13/00*** | (2006.01) |
| ***E05B 13/10*** | (2006.01) |
| ***E05B 1/00*** | (2006.01) |

(52) U.S. Cl.

CPC ..... *E05B 13/105* (2013.01); *E05B 1/0007* (2013.01)

(58) Field of Classification Search

CPC .... E05B 13/101; E05B 13/105; E05B 1/0007; E05B 55/005; B60R 25/0222

USPC ..... 70/221–224, 472, DIG. 37

See application file for complete search history.

(56) References Cited

U.S. PATENT DOCUMENTS

| | | | | | |
|---|---|---|---|---|---|
| 2,950,615 | A * | 8/1960 | Schlage | E05B 1/0038 | 70/216 |
| 3,922,896 | A * | 12/1975 | Kagoura | E05B 55/005 | 70/223 |
| 4,966,399 | A * | 10/1990 | Lin | E05B 55/005 | 292/359 |
| 5,284,372 | A * | 2/1994 | Lin | E05B 55/005 | 292/169.17 |
| 5,460,417 | A * | 10/1995 | Zuckerman | E05B 13/106 | 292/175 |
| 5,816,086 | A * | 10/1998 | Russell, IV | E05B 13/101 | 70/422 |
| 5,934,117 | A * | 8/1999 | Shen | E05B 55/06 | 70/149 |
| 5,941,108 | A * | 8/1999 | Shen | E05B 55/005 | 292/336.3 |
| 6,038,894 | A * | 3/2000 | Hu | E05B 55/005 | 292/336.5 |

(Continued)

*Primary Examiner* — Suzanne L Barrett

(74) *Attorney, Agent, or Firm* — Matthias Scholl P.C.; Matthias Scholl

(57) ABSTRACT

A lock, including an outer subassembly, an inner subassembly, a safety mechanism, and a clutch. The clutch includes a square transmission tube and a sub-clutch. The safety mechanism includes a brake rod and a drive device. The inner subassembly includes an inner baffle plate, an inner baffle plate cover, a cylindrical tube, a transmission frame, and an inner doorknob. The inner baffle plate is inserted in the inner baffle plate cover. The cylindrical tube fits rotations of the inner baffle plate and the inner baffle plate cover. The transmission frame is disposed at one end of the cylindrical tube, and the inner doorknob is disposed at the other end of the cylindrical tube. The drive device includes a transmission member, a drive member, a first spring, a second spring, and a positioning slot. The positioning slot is disposed on the cylindrical tube.

5 Claims, 4 Drawing Sheets

(56) References Cited

U.S. PATENT DOCUMENTS

| | | | | |
|---|---|---|---|---|
| 6,141,998 | A * | 11/2000 | Seo | E05B 1/0092 70/224 |
| 6,351,976 | B1 * | 3/2002 | Chen | E05B 13/10 292/336.3 |
| 6,425,273 | B1 * | 7/2002 | Kim | E05B 55/005 292/336.3 |
| 6,615,630 | B2 * | 9/2003 | Wu | E05B 13/005 292/336.3 |
| 6,993,945 | B1 * | 2/2006 | Chen | E05B 13/101 292/DIG. 27 |
| 7,870,772 | B1 * | 1/2011 | Guo | E05B 13/108 292/DIG. 27 |
| 7,934,754 | B2 * | 5/2011 | Mathachan | E05B 13/002 292/336.3 |
| 9,228,374 | B2 * | 1/2016 | Huang | E05B 55/005 |
| 9,611,672 | B2 * | 4/2017 | Murphy | E05B 55/005 |
| 9,945,152 | B2 * | 4/2018 | Huang | E05B 17/044 |
| 2004/0237608 | A1 * | 12/2004 | Chen | E05B 13/101 70/224 |

* cited by examiner

DOOR LOCK

BACKGROUND OF THE INVENTION

Field of the Invention

The invention relates to a press-type spherical door lock.

Description of the Related Art

Conventional door locks include an outer subassembly, an inner subassembly, a safety mechanism, and a clutch. The clutch includes a square transmission tube and a sub-clutch. The safety mechanism includes a brake rod and a drive device. When the drive device is rotated in one direction, the brake rod is rotated with the drive device, and the safety mechanism is locked. The safety mechanism is unlocked as the drive device is rotated in reverse.

Because the locking and unlocking of the safety mechanism are determined by the rotation direction of the drive device, under circumstances, the drive device may be rotated in a wrong direction, causing problems.

SUMMARY OF THE INVENTION

In view of the above-described problems, it is one objective of the invention to provide a press-type spherical door lock that is easy to operate without regard to the rotation direction of the drive device, eliminating potential problems.

To achieve the above objective, in accordance with one embodiment of the invention, there is provided a press-type spherical door lock, comprising an outer subassembly, an inner subassembly, a safety mechanism, and a clutch. The clutch comprises a square transmission tube and a sub-clutch. The safety mechanism comprises a brake rod and a drive device. The inner subassembly comprises an inner baffle plate, an inner baffle plate cover, a cylindrical tube, a transmission frame, and an inner doorknob. The inner baffle plate is inserted in the inner baffle plate cover. The cylindrical tube fits rotations of the inner baffle plate and the inner baffle plate cover. The transmission frame is disposed at one end of the cylindrical tube, and the inner doorknob is disposed at the other end of the cylindrical tube. The drive device comprises a transmission member, a drive member, a first spring, a second spring, and a positioning slot. The positioning slot is disposed on the cylindrical tube. The transmission member comprises a first brake rod hole and a first pin hole. The first brake rod hole is disposed at a central part of the transmission member. The drive member comprises a head, a main body, a positioning bolt, and a pin body. The positioning bolt is disposed at a circumferential surface of the main body, and the pin body is disposed on one end of the main body at an axial direction. The inner doorknob comprises a connecting hole and a head guide hole. The head guide hole is at one end of the connecting hole. The cylindrical tube is inserted in the connecting hole of the inner doorknob. The transmission member is disposed on a base body in the cylindrical tube. The cylindrical tube and the main body of the drive member are coupled by sliding fit. The first spring is disposed between the transmission member and the main body. The head of the drive member and the head guide hole are coupled by sliding fit. The pin body matches with the first pin hole. The positioning bolt matches with the positioning slot. The second spring is sleeved on the head of the drive member. One end of the second spring matches with the main body, and the other end of the second spring matches with a bottom plate at the head guide hole. A casing is sleeved on the brake rod. The casing is disposed between the square transmission tube and the transmission member.

In a class of this embodiment, the positioning slot comprises a spiral guide slot and a circumferential positioning slot. The positioning bolt and the spiral guide slot are coupled by sliding fit. The positioning bolt is positioned in the circumferential positioning slot.

In a class of this embodiment, the inner doorknob is spherical. The inner doorknob comprises a hollow inner sphere and a shell. The connecting hole is in a diametrical line of the inner sphere. One end of the connecting hole is provided with a connecting tube. One side of the shell is open, and the other side of the shell is provided with the bottom plate. The head guide hole is disposed at the bottom plate. The cylindrical tube is inserted in the connecting tube. The head of the drive member and the head guide hole are coupled by sliding fit. The second spring matches with the bottom plate of the shell.

In a class of this embodiment, the inner doorknob comprises a base and a doorknob. One end of the base is provided with the connecting hole, and the other end of the base is provided with the head guide hole. The cylindrical tube is inserted in the connecting hole on the base. The head of the drive member and the head guide hole on the base are coupled by sliding fit.

In a class of this embodiment, the casing comprises a second brake hole. The second brake rod hole is disposed at a central part of the casing. A cylinder is disposed between the casing and a connecting end of the transmission member. The cylinder comprises a second pin hole. The second pin hole is corresponding to the first pin hole on the transmission member.

In a class of this embodiment, the casing is a rubber casing.

Advantages of the lock according to embodiments of the invention are summarized as follows:

The press-type emergency spherical door lock comprises the drive device. To lock the safety mechanism, the drive device is pressed, and the drive device slides in the cylindrical tube and presses the first spring; the pin body on the drive device is inserted in the pin hole on the transmission member; the drive device rotates during the sliding, and the brake rod also rotates, so the safety mechanism is locked. The safety mechanism is unlocked by rotating the doorknob, irrespective of the rotation direction, thus eliminating hidden risks.

BRIEF DESCRIPTION OF THE DRAWINGS

The invention is described hereinbelow with reference to the accompanying drawings, in which.

DETAILED DESCRIPTION OF THE EMBODIMENTS

Figure 1:
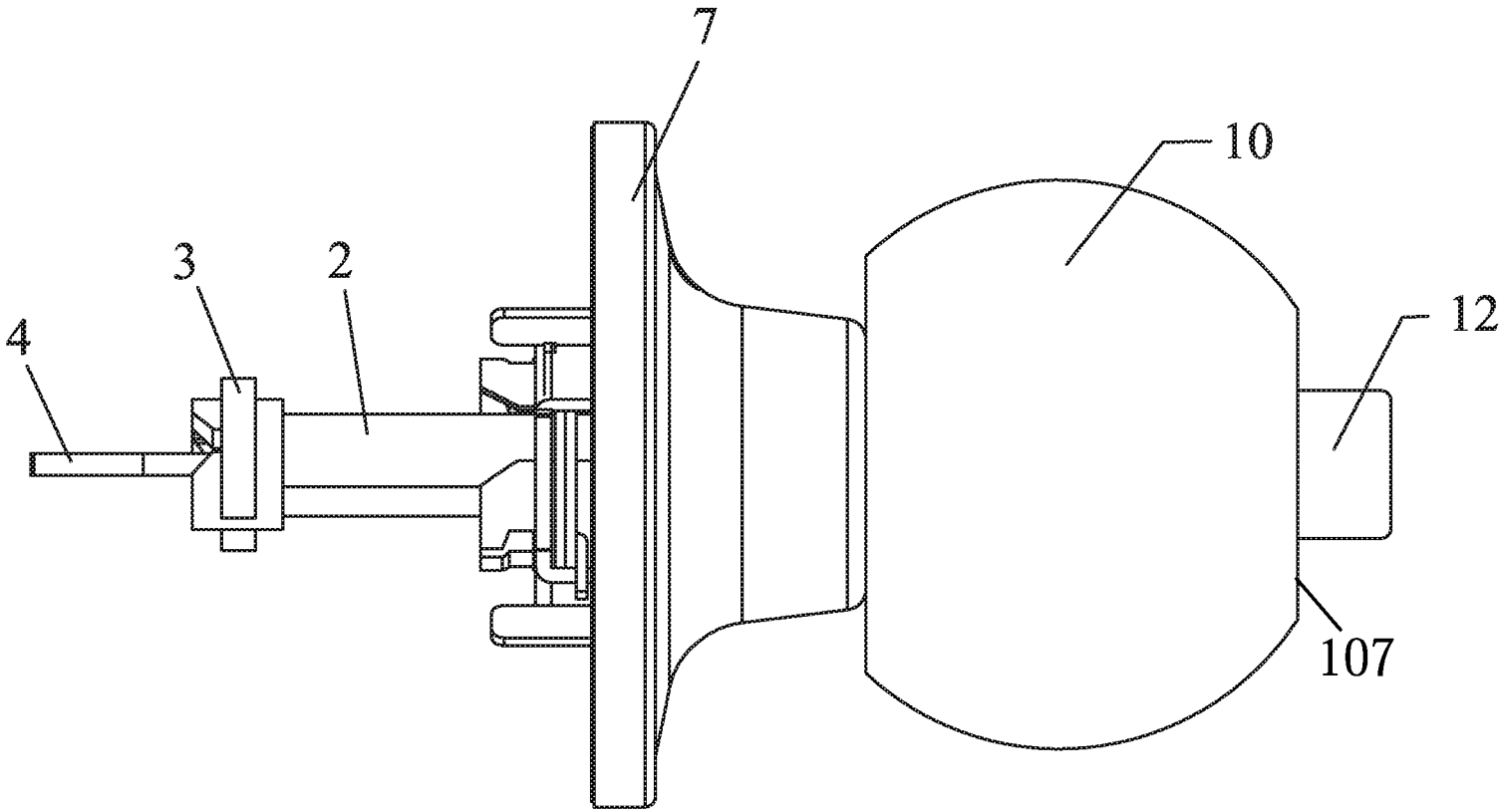
FIG. 1 is a front view of a spherical door lock in accordance with one embodiment of the invention.

For further illustrating the invention, experiments detailing a spherical door lock are described below.

Example 1

As shown in FIGS. 1-4, a press-type emergency spherical door lock comprises an outer subassembly 16, a lock core subassembly, an inner subassembly 1, a safety mechanism, and a clutch. The clutch comprises a square transmission tube 2 and a sub-clutch. 3 The safety mechanism comprises a brake rod 4 and a drive device 5. The inner subassembly comprises an inner baffle plate 6, an inner baffle plate cover 7, a cylindrical tube 8, a transmission frame 9, and an inner doorknob 10. The inner baffle plate 6 is inserted in the inner baffle plate cover 7. The cylindrical tube 8 fits rotations of the inner baffle plate 6 and the inner baffle plate cover 7. The transmission frame 9 is disposed at one end of the cylindrical tube 8, and the inner doorknob 10 is disposed at the other end of the cylindrical tube 8. The cylindrical tube 8, the transmission frame 9, and the inner doorknob 10 rotate synchronously. The square transmission tube 2 rotates with the transmission frame 9. The sub-clutch 3 matches with a main clutch on the outer subassembly 16.

A locking member 15 is disposed on the brake rod 4 between the sub-clutch 3 and the outer subassembly 16. The locking member 15 comprises a third brake rod hole 151 and a locking lug 152. The third brake rod hole and the locking lug are on the brake rod 4. The outer subassembly 16 comprises a locking slot 161, and the locking slot matches with the locking lug 152.

The drive device comprises a transmission member 11, a drive member 12, a first spring 13, a second spring 14, and a positioning slot 81. The positioning slot 81 is disposed on the cylindrical tube 8.

The transmission member 11 comprises a first brake rod hole 111 and first pin holes 112. The first brake rod hole is disposed at a central part of the transmission member. The first pin holes 112 are two in number.

A casing is sleeved on the brake rod. The casing 17 is a rubber casing. The casing 17 comprises a second brake hole 171. The second brake rod hole is disposed at a central part of the casing. A cylinder 172 is disposed between the casing 17 and a connecting end of the transmission member 11. The cylinder 172 comprises second pin holes 173. The second pin holes are corresponding to the first pin holes 112 on the transmission member 11.

The drive member 12 comprises a head 121, a main body 122, a positioning bolt 123, and a pin body 124. The positioning bolt is disposed at a circumferential surface of the main body, and the pin body is disposed on one end of the main body at an axial direction. The inner doorknob 10 comprises a connecting hole 108 and a head guide hole 104. The head guide hole 104 is at one end of the connecting hole 108. The inner doorknob 10 is spherical. The inner doorknob 10 comprises a hollow inner sphere 101 and a shell 102. The connecting hole 108 is in a diametrical line of the inner sphere 101. One end of the connecting hole 108 is provided with a connecting tube 103. One side of the shell 102 is open, and the other side of the shell is provided with a bottom plate 107. The head guide hole 104 is disposed at the bottom plate 107. The cylindrical tube 8 is inserted in the connecting tube 103, and can be disassembled. The head 121 of the drive member 12 and the head guide hole 104 are coupled by sliding fit. The second spring 14 matches with the bottom plate 107 of the shell 102.

The cylindrical tube 8 is inserted in the connecting hole 108 of the inner doorknob 10. The transmission member 11 is disposed on a base body in the cylindrical tube 8. The main body 122 of the drive member 12 and the cylindrical tube 8 are coupled by sliding fit. The first spring 13 is disposed between the transmission member 11 and the main body 122. The head 121 of the drive member and the head guide hole 104 are coupled by sliding fit. The pin body 124 matches with the first pin holes 112. The positioning bolt 123 matches with the positioning slot 81. The second spring 14 is sleeved on the head 121 of the drive member 12. One end of the second spring matches with the main body 122, and the other end of the second spring matches with a bottom plate 107 at the head guide hole 104 of the shell 102.

The positioning slot 81 comprises a spiral guide slot 811 and a circumferential positioning slot 812. The spiral guide slot and the circumferential positioning slot are on the cylindrical tube 8. The spiral guide slot 811 and the positioning bolt 123 are coupled by sliding fit. The positioning bolt 123 is positioned in the circumferential positioning slot 812.

Figure 2:
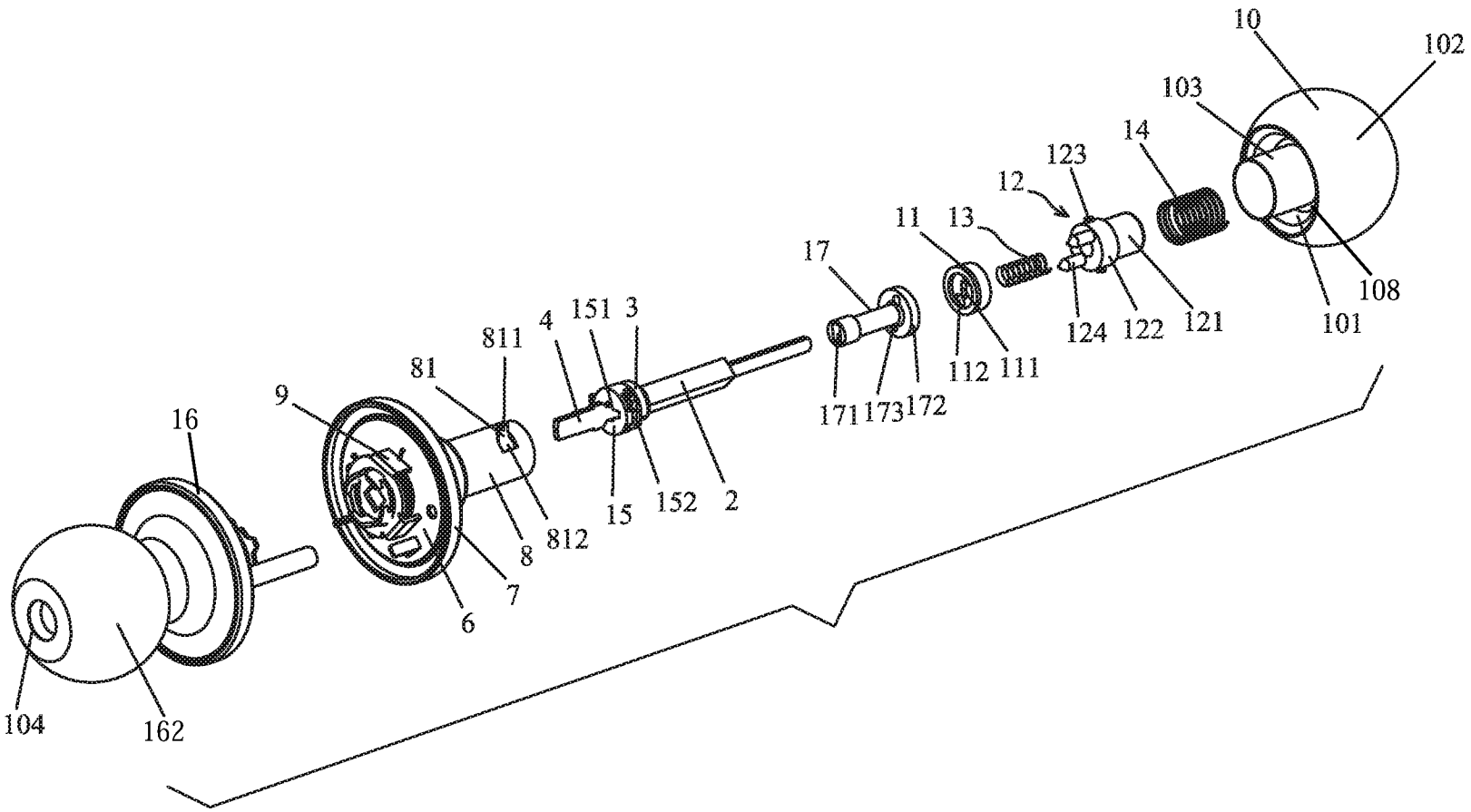
FIG. 2 is an exploded view of a spherical door lock in accordance with one embodiment of the invention.
Figure 3:
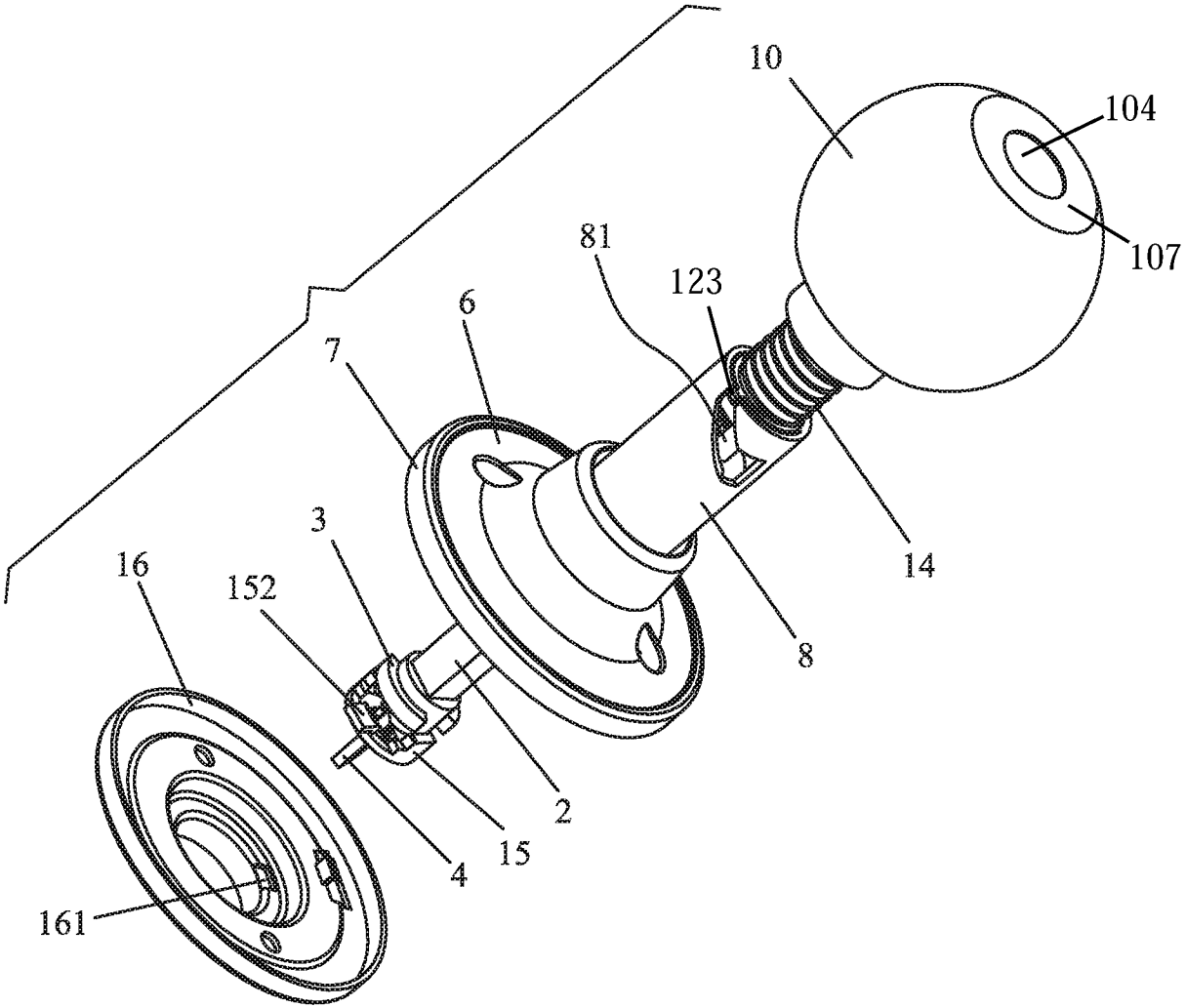
FIG. 3 is a partial exploded view of a spherical door lock in accordance with one embodiment of the invention.

In use, as shown in FIGS. 1-3, the head 121 of the drive member 12 is pressed, and the drive member 12 is driven to move and press the first spring 13. The pin body 124 is inserted through the first pin holes 112 on the transmission member 11 and the second pin holes 173 on the casing 17. The positioning bolt 123 slides in the positioning slot 811, and drives the transmission member 11 and the casing 17 to rotate and move downwards. The casing 17 and the brake rod 4 are driven by the transmission member 11 to rotate and move downwards. Meanwhile, the square transmission tube 2 drives the sub-clutch 3 to move downwards and further drives the locking member 15 to move downwards, and the locking lug 152 on the locking member 15 is secured to the locking slot 161 on the outer subassembly 16, thus the door is locked, and an outer doorknob 162 cannot be rotated.

When the positioning bolt 123 is positioned in the positioning slot 812, the safety mechanism is locked. The safety mechanism can be unlocked by rotating the inner doorknob 10 clockwise or anticlockwise. The positioning bolt 123 slides off the positioning slot 812 and slides along the spiral guide slot 811. The second spring 14 drives the head 121 of the drive member 12 to reset, meanwhile, the locking lug 152 on the locking member 15 is departed from the locking slot 161 on the outer subassembly 16, thus the door is unlocked by rotating the inner doorknob. The certain rotation direction of the doorknob in the prior art which needs to be memorized is abandoned.

Example 2

Figure 4:
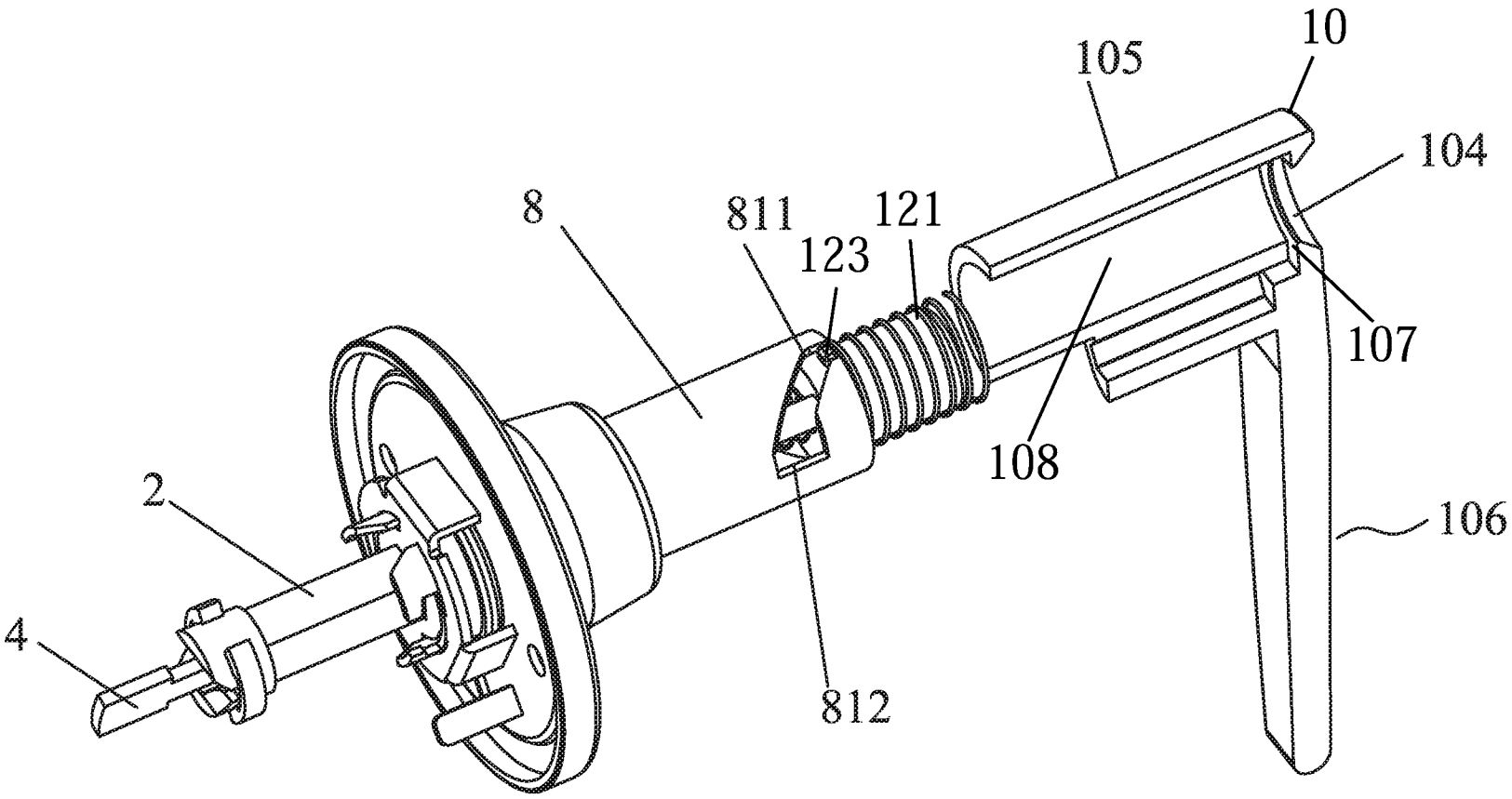
FIG. 4 is a stereogram of a spherical door lock in Example 2.

As shown in FIG. 4, the inner doorknob 10 comprises a base 105 and a doorknob 106. One end of the base 105 is provided with the connecting hole 108, and the other end of the base is provided with the head guide hole 104. The cylindrical tube 8 is inserted in the connecting hole 108 on the base 105. The head 121 of the drive member and the head guide hole 104 on the base 105 are coupled by sliding fit.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A lock, comprising:

an outer doorknob comprising an escutcheon plate having a locking slot;

an inner baffle plate comprising a through hole;

an inner baffle plate cover;

a cylindrical tube, the cylindrical tube comprising a tube sidewall and a through hole, and the tube sidewall comprising a positioning slot having a spiral guide slot and a circumferential positioning slot;

a transmission frame, the transmission frame comprising a through hole;

an inner doorknob; the inner doorknob comprising a shell, the shell comprising a bottom plate having a head guide hole, and a housing part having an inner chamber and extending from the bottom plate; and a safety mechanism, the safety mechanism comprising a brake rod, a rod casing having a cylinder and a sleeve portion extending from the cylinder, a locking lug, a drive member, a spring, and the positioning slot of the cylindrical tube; the cylinder of the rod casing comprising a pin hole; and the drive member comprising a head, a main body having two end walls and a cylindrical sidewall extending between the two end walls, a positioning bolt, and a pin body;

wherein:

the inner baffle plate is fixedly disposed within the inner baffle plate cover;

the inner baffle plate cover is adapted to be fixedly coupled to the escutcheon plate of the outer doorknob;

the cylindrical tube extends through the through hole of the inner baffle plate, and the through hole of the cylindrical tube and the through hole of inner baffle plate are coaxially disposed around a central axis;

the transmission frame is fixedly disposed at one end of the cylindrical tube, and the housing part of the inner doorknob is fixedly disposed at the other end of the cylindrical tube;

the through hole of the cylindrical tube is connected to the through hole of the transmission frame;

the inner baffle plate is disposed between and abuts against the transmission frame and the housing part of the inner doorknob;

the inner doorknob, the cylindrical tube, and the transmission frame are rotatable with respect to the inner baffle plate around the central axis;

the positioning bolt of the drive member is disposed at the cylindrical sidewall of the main body, and the head and the pin body of the drive member extend axially from two end walls of the main body, respectively; and the head guide hole of the inner doorknob is connected to the inner chamber of the inner doorknob;

the cylindrical tube is disposed in the inner chamber of the inner doorknob;

the spiral guide slot of the cylindrical tube extends axially and perpendicularly with respect to the central axis;

the circumferential positioning slot of the cylindrical tube is disposed at one end of the spiral guide slot of the cylindrical tube and extends perpendicularly with respect to the central axis;

the main body and the pin body of the drive member are disposed in the through hole of the cylindrical tube; and the main body of the drive member is movable in the through hole of the cylindrical tube along the central axis and rotatable with respect to the cylindrical tube around the central axis;

the head of the drive member is disposed in the inner chamber of the inner doorknob and extends through the head guide hole of the inner doorknob; and the head of the drive member is movable in the inner chamber and the head guide hole of the inner doorknob along the central axis;

the positioning bolt of the drive member is disposed in and movable along the spiral guide slot of the cylindrical tube;

the spring is sleeved on the head of the drive member; and one end of the spring is connected to the main body of the drive member, and the other end of the spring is connected to the bottom plate of the inner doorknob;

the rod casing is disposed in the through hole of the cylindrical tube, and the pin body of the drive member is disposed in the pin hole of the rod casing;

one end of the brake rod extends through the through hole of the transmission frame and disposed in the through hole of the cylindrical tube, and the sleeve portion of the rod casing is sleeved on the one end of the brake rod; and the locking lug is disposed on the other end of the brake rod;

the rod casing together with the brake rod and the locking lug is movable in the through hole of the cylindrical tube along the central axis and rotatable with respect to the cylindrical tube around the central axis; and the locking lug is adapted to be disposed in the locking slot of the outer doorknob.

2. The lock of claim 1, wherein the inner doorknob is spherical; the inner chamber of the inner doorknob is spherical; a connecting tube is disposed in the inner chamber of the inner doorknob; and the cylindrical tube is disposed in the connecting tube.

3. The lock of claim 1, wherein the inner doorknob further comprises a doorknob.

4. The lock of claim 1, wherein the rod casing is a rubber casing.

5. The lock of claim 1, wherein:

when the head of the drive member is pressed:

the main body of the drive member is moved toward the outer doorknob, the positioning bolt of the drive member is moved along the spiral guide slot of the cylindrical tube toward the circumferential positioning slot of the cylindrical tube, and the drive member is rotated with respect to the cylindrical tube; and the rod casing together with the brake rod and the locking lug is driven by the pin body of the drive member to move toward the outer doorknob and rotate with respect to the cylindrical tube;

wherein when the positioning bolt of the drive member is disposed in the circumferential positioning slot of the cylindrical tube, the spring is stretched, and the locking lug is locked in the locking slot of the outer doorknob to fasten the lock;

when the inner doorknob is rotated with respect to the inner baffle plate after the lock is fastened:

the cylindrical tube is rotated with respect to the drive member to move the positioning bolt of the drive member out of the circumferential positioning slot of the cylindrical tube; and the drive member is moved away from the outer doorknob for resetting due to the restoring action of the spring, and the rod casing together with the brake rod and the locking lug is driven by the pin body of the drive member to move away from the outer doorknob, wherein the locking lug is detached from the locking slot of the outer doorknob to unfasten the lock.

* * * * *